US006077155A

United States Patent [19]

Hayakawa et al.

[11] Patent Number: 6,077,155

[45] Date of Patent: Jun. 20, 2000

[54] POLISHING DEVICE AND CORRECTING METHOD THEREFOR

[75] Inventors: Hideaki Hayakawa; Takatoshi Saito; Yoshiaki Komuro; Shuzo Sato, all of Kanagawa, Japan

[73] Assignee: Sony Corporation, Tokyo, Japan

[21] Appl. No.: 08/909,053

[22] Filed: Aug. 11, 1997

Related U.S. Application Data

[62] Division of application No. 08/628,325, Apr. 5, 1996, Pat. No. 5,681,212.

[30] Foreign Application Priority Data

Apr. 14, 1995 [JP] Japan ..... P07-089285

[51] Int. Cl.[7] ..... B24B 53/00

[52] U.S. Cl. ..... 451/288; 451/443

[58] Field of Search ..... 451/288, 287, 451/443, 444, 56

[56] References Cited

U.S. PATENT DOCUMENTS 5,779,521 7/1998 Muroyama et al. ..... 451/288

FOREIGN PATENT DOCUMENTS 7149158 9/1982 Japan ..... 451/72
3068360 3/1988 Japan ..... 451/288
3283859 11/1988 Japan ..... 451/288

*Primary Examiner*—Robert A. Rose
*Attorney, Agent, or Firm*—Rader, Fishman & Grauer; Ronald P. Kananen

[57] ABSTRACT

Disclosed herein is a polishing device including a polishing plate having an upper surface on which a polishing pad is attached, a polishing head having a lower surface opposed to an upper surface of the polishing pad on the polishing plate, for holding a substrate to be polished on the lower surface, and a pressure source for applying a polishing pressure to the polishing head, whereby the substrate held by the polishing head is pressed against the upper surface of the polishing pad under the polishing pressure applied from the pressure source to perform polishing of the substrate. The polishing head is provided with a contact pressure adjusting mechanism capable of adjusting an in-plane contact pressure of the substrate against the upper surface of the polishing pad on the polishing plate at every area of the substrate. Accordingly, the uniformity and the planarity in the plane of the substrate surface to be polished can be improved with a high throughput.

2 Claims, 5 Drawing Sheets

POLISHING DEVICE AND CORRECTING METHOD THEREFOR

This application is a division of application Ser. No. 08/628,325 filed Apr. 5, 1996 now U.S. Pat. No. 5,681,212.

BACKGROUND OF THE INVENTION

The present invention relates to a polishing device for polishing a substrate held by a polishing head as pressing the substrate against the upper surface of a polishing pad mounted on a polishing plate, and more particularly to a polishing device suitably used in polishing or global planarization of interlayer dielectrics on a semiconductor wafer.

In multilayer wiring in an LSI process, planarization of interlayer dielectrics is a very important technique. In connection with the exposure for wiring patterns on dielectrics, the depth of focus tends to be reduced in accordance with the miniaturization of wiring structures. To cope with this tendency, it is desired to establish a technique for globally planarizing steps on a wafer surface.

Various planarization techniques for interlayer dielectrics such as coating, reflowing, etching, PVD (Physical Vapor Deposition), and CVD (Chemical Vapor Deposition) have been proposed and applied. However, none of these techniques have yet realized global planarization necessary for higher miniaturization and higher integration.

Recently, chemical/mechanical polishing which applies mirror polishing to silicon wafers has been proposed for realizing global planarization with a high throughput.

FIG. 8 is a schematic side view of a polishing device according to the prior art, illustrating the configuration of a chemical mechanical polishing device used for planarization polishing of interlayer dielectrics on a semiconductor wafer.

In the polishing device shown in FIG. 8, a polishing pad 2 of a porous material is attached to the upper surface of a polishing plate (polishing bed) 1. The polishing plate 1 is horizontally supported by a plate rotating shaft 3, and is rotationally driven through the plate rotating shaft 3 in polishing.

A polishing head 4 is located above the polishing plate 1 so as to face a pad surface 2*a* of the polishing pad 2 on the polishing plate 1. A substrate attachment film 5 of urethane rubber of the like is attached to the lower surface of the polishing head 4, which surface is opposed to the pad surface 2*a* of the polishing pad 2. A substrate 6 to be polished is held through the substrate attachment film 5 to the polishing head 4 in polishing. The polishing head 4 is mounted to a head rotating shaft 8 through a universal joint 7 using a spherical sliding bearing or the like, and is rotationally driven through the head rotating shaft 8 in polishing.

A nozzle 9 for supplying a polishing agent (slurry) 11 is provided in the vicinity of the polishing head 4. The polishing agent 11 is fed from a polishing agent supply system 10 onto the pad surface 2*a* of the polishing pad 2.

The operation of the prior art polishing device mentioned above will now be described.

Prior to polishing, the substrate 6 such as a semiconductor wafer is attached through the substrate attachment film 5 to the lower surface of the polishing head 4. During polishing, the polishing plate 1 and the polishing head 4 are rotationally driven through the rotating shafts 3 and 8, respectively, by driving means (not shown). At this time, the polishing agent 11 is supplied from the polishing agent supply system 10 through the nozzle 9 onto the polishing pad 2. The substrate 6 held by the polishing head 4 is then pressed against the pad surface 2*a* under a given polishing pressure applied from pressurizing means (not shown). Accordingly, the subject surface (lower surface) of the substrate 6 is polished by the combination of a chemical polishing action by alkali contained in the polishing agent 11, and a mechanical polishing action by silica contained in the polishing agent 11.

In the prior art polishing device, even if there is a slight inclination (nonparallelisin) between the polishing plate 1 and the polishing head 4, the substrate 6 can be brought into uniform contact with the pad surface 2*a* by the following function of the universal joint 7. However, when the polishing pressure by the pressurizing means is set to a high value in order to respond to a high throughput, even a slight change in distribution of contact pressures in the plane of the subject surface of the substrate 6 with respect to the pad surface 2*a* may remarkably reduce uniformity and planarity in the plane of the subject surface of the substrate 6. Further, the distribution of contact pressures is readily varied by dimensional errors in the construction of the polishing device, malfunction of the universal joint 7 due to deposition of the polishing agent 11, misalignment between the head rotating shaft 8 and the substrate 6 in setting the substrate 6 on the polishing head 4, etc. Moreover, this polishing device cannot cope with various factors reducing uniformity of polishing in the plane of the substrate surface, such as the fact that the amount of polishing at an outer circumferential portion of the substrate is larger than that at a central portion of the substrate, because the polishing agent 11 tends to be supplied to the outer circumferential portion more smoothly than to the central portion. Additionally, in the case that the subject surface of the substrate 6 is tapering (inclined), the tapering of the subject surface is maintained by the following function of the universal joint in polishing, so that a desired level surface of the substrate 6 cannot be achieved using this polishing device.

SUMMARY OF THE INVENTION

It is therefore a primary object of the present invention to provide a polishing device which can realize a high throughput and improve the uniformity and the planarity in the plane of the surface of a substrate to be polished.

According to a first aspect of the present invention, there is provided in a polishing device including a polishing plate having an upper surface on which a polishing pad is attached, a polishing head having a lower surface opposed to an upper surface of the polishing pad on the polishing plate, for holding a substrate to be polished on the lower surface, and pressurizing means for applying a polishing pressure to the polishing head, whereby the substrate held by the polishing head is pressed against the upper surface of the polishing pad under the polishing pressure applied from the pressurizing means to perform polishing of the substrate; the improvement wherein the polishing head is provided with a contact pressure adjusting mechanism capable of adjusting an in-plane contact pressure of the substrate against the upper surface of the polishing pad on the polishing plate at every area of the substrate.

With this configuration, the in-plane contact pressure of the substrate against the upper surface of the polishing pad can be adjusted at every area of the substrate. Accordingly, the distribution of contact pressures in the plane of the surface of the substrate to be polished can be corrected to cope with various factors reducing the uniformity of polishing in the plane of the substrate surface.

According to a second aspect of the present invention, there is provided in a polishing device including a polishing plate having an upper surface on which a polishing pad is attached, and a plurality of polishing heads each having a lower surface opposed to an upper surface of the polishing pad on the polishing plate, for holding a plurality of substrates to be polished on the lower surface, hereby the substrates held by The polishing heads are pressed against the upper surface of the polishing pad to perform polishing of the substrates; the improvement comprising a plurality of dressers provided so as to respectively correspond to the polishing heads, for dressing the upper surface of the polishing pad.

With this configuration, the plural dressers for dressing the upper surface of the polishing pad are provided so as to respectively correspond to the plural polishing heads. Accordingly, it is possible to eliminate variations in polishing amount between the polishing heads due to a difference in dressed condition between areas of the upper surface of the polishing pad.

According to a third aspect of the present invention, there is provided in a polishing device including a polishing plate having an upper surface on which a polishing pad is attached, and a polishing head having a lower surface opposed to an upper surface of the polishing pad on the polishing plate, for holding a substrate to be polished on the lower surface, whereby the substrate held by the polishing head is pressed against the upper surface of the polishing pad to perform polishing of the substrate; the improvement comprising a moving member movable in a radial direction of the polishing plate; and a displacement sensor mounted through a sensor mounting member to the moving member, for detecting a change in shape of the upper surface of the polishing pad on the polishing plate according to an amount of movement of the moving member.

With this configuration, when the moving member is moved in the radial direction of the polishing plate, a change in shape of the upper surface of the polishing pad on the polishing plate according to an amount of movement of the moving member can be detected by the displacement sensor. Accordingly, the shape of the upper surface of the polishing pad can be accurately grasped as a curved line.

According to a fourth aspect of the present invention, there is provided in a polishing device including a polishing plate having an upper surface on which a polishing pad is attached, a polishing head having a lower surface opposed to an upper surface of the polishing pad on the polishing plate, for holding a substrate to be polished through a substrate attachment film attached to the lower surface, and driving means for rotationally driving the polishing plate and the polishing head, whereby the substrate attached to the substrate attachment film is pressed against the upper surface of the polishing pad to perform polishing of the substrate; a correcting method for the polishing device, comprising the steps of removing the substrate from the substrate attachment film before rotating the polishing plate and the polishing pad; and pressing the substrate attachment film against the upper surface of the polishing pad on the polishing plate during rotation of the polishing plate and the polishing head to make a lower surface of the substrate attachment film rub against the upper surface of the polishing pad preliminarily trued.

With this configuration, as rotating the polishing plate and the polishing head, the substrate attachment film attached to the polishing head is pressed against the upper surface of the polishing pad preliminarily trued, thereby making the lower surface of the substrate attachment film rub against the upper surface of the polishing pad. Accordingly, the shape of the upper surface of the polishing pad as a reference shape is transferred to the lower surface of the substrate attachment film, thereby matching the upper surface of the polishing pad and the lower surface of the substrate attachment film.

As described above, according to the first aspect of the present invention, the polishing head is provided with the contact pressure adjusting mechanism capable of adjusting the in-plane contact pressure of the substrate against the upper surface of the polishing pad at every area of the substrate. Accordingly, the distribution of contact pressures in the plane of the substrate surface can be corrected so as to cope with various factors reducing the uniformity and the planarity in the plane of the substrate surface. As a result, even when the polishing pressure to be applied from the pressurizing means is set to a high value, so as to obtain a high throughput, the polishing of the substrate surface with improved uniformity and planarity can be realized.

According to the second aspect of the present invention, the plural dressers for dressing the upper surface of the polishing pad are provided so as to respectively correspond to the plural polishing heads in a multihead type (batch type) polishing device. Accordingly, it is possible to eliminate variations in polishing amount between the plural polishing heads due to a difference in dressed condition between areas of the pad surface, and a high throughput in such a multihead type polishing device can be realized.

According to the third aspect of the present invention, a change in shape of the pad surface of the polishing pad mounted on the polishing plate can be detected by the displacement sensor according to an amount of movement of the moving member in the radial direction of the polishing plate. Accordingly, the shape of the pad surface can be accurately grasped as a curved line. Further, time and labor required to read a dial of a dial gauge or the like can be eliminated to thereby reduce measurement time.

According to the fourth aspect of the present invention, as rotating the polishing plate and the polishing head, the substrate attachment film attached to the polishing head is pressed against the preliminarily trued pad surface of the polishing pad mounted on the polishing plate, thereby transferring the reference shape of the pad surface to the film surface of the substrate attachment film. Accordingly, the pad surface and the film surface can be matched together to thereby eliminate the nonuniformity of polishing in the plane of the substrate surface due to mismatch of these surfaces.

The present invention largely contributes to an LSI process under the 0.3&Lm rule or Later rule, especially as a planarization technique for interlayer dielectrics in a semiconductor wafer process.

Other objects and features of the invention will be more fully understood from the following detailed description and appended claims when taken with the accompanying drawings.

DETAILED DESCRIPTION OF THE PREFERRED EMBODIMENTS

Figure 1A:
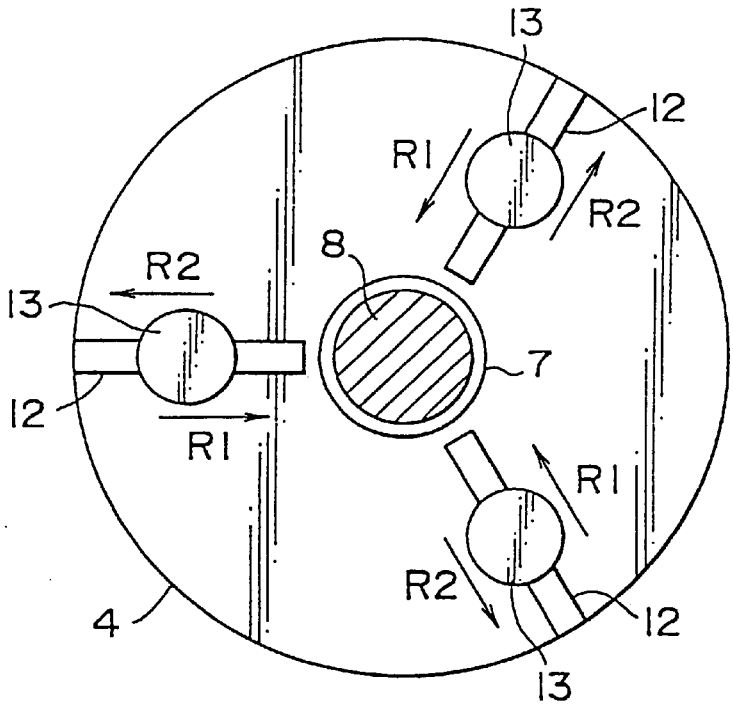
FIGS. 1A and 1B are a top plan view and a side view, respectively, of a polishing device according to a first preferred embodiment of the present invention.

There will now be described in detail with reference to the drawings some preferred embodiments of the present invention applied to a chemical mechanical polishing device for use in planarization polishing of a semiconductor wafer, for example. It is to be noted that the polishing device according to the present invention is not limited in its application to such a chemical mechanical polishing device, but may be applied generally to a so-called complexed polishing device utilizing a complexed physical and chemical operation, such as mechanochemical polishing mainly adopting a mechanical polishing operation or chemomechanical polishing mainly adopting a chemical polishing operation. In the following description of the preferred embodiments, the same reference numerals as those in the prior art denote similar parts for convenience of illustration, and the description thereof will be omitted to avoid repetition.

Figure 1B:
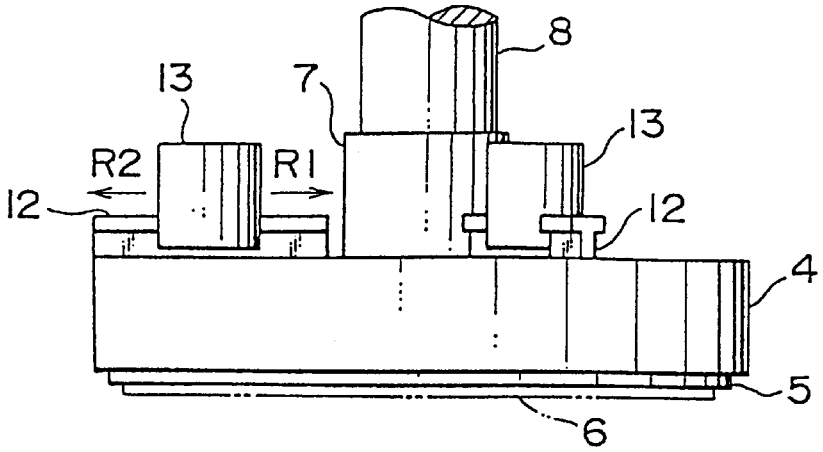

FIGS. 1A and 1B are views illustrating a first preferred embodiment of the polishing device according to the present invention, in which FIG. 1A is a top plan view of an essential part of the polishing device and FIG. 1B is a side view of FIG. 1A.

Referring to FIGS. 1A and 1B, a polishing device 4 is provided with a contact pressure adjusting mechanism which can adjust an in-plane contact pressure of a substrate 6 to be polished at its every area with respect to the upper surface of a polishing pad on a polishing plate (not shown).

The contact pressure adjusting mechanism consists of three guide members 12 mounted on the upper surface of the polishing head 4, three weight load members 13 respectively movably engaged wish the three guide members 12, and three clamping means (to be hereinafter described) for fixing the weight load members 13 to the respective guide members 12.

Each guide member 12 has a rail structure having a substantially T-shaped cross section, and radially extends From a universal joint 7 connecting a head rotating shaft 8 to the polishing head 4 in the radial direction of the polishing head 4. The three guide members 12 are placed at circumferentially equal intervals, that is, at a circular pitch of 120° on the polishing head 4.

Each weight load member 13 has a columnar shape, and it is formed of a metal material. A lower end portion of each weight load member 13 is formed with a T-shaped groove having a sectional shape corresponding to the sectional shape of each guide member 12. Thus, each weight load member 13 is movably engaged through its T-shaped groove with the corresponding guide member 12.

Figure 2:
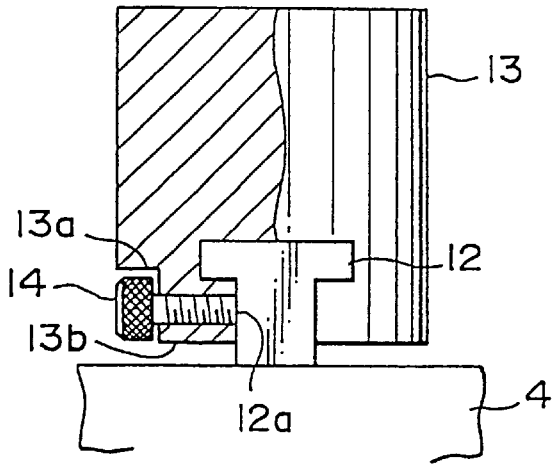
FIG. 2 is a partially cutaway, side view illustrating clamping means in the first preferred embodiment.

As shown in FIG. 2, a clamping screw 14 as an example of each clamping means is threadedly engaged with the lower end portion of each weight load member 13. The lower end portion of each weight load member 13 is formed with a recess 13*a* and a zapped hole 13*b* extending from the recess 13*a* to the T-shaped groove. The clamping screw 14 is threadedly engaged in the tapped hole 13*b*, and the tip of the clamping screw 14 abuts against one side surface 12*a* of the T-shaped guide member 12, thereby restricting the movement of the weight load member 13.

The operation of the polishing device having the above-mentioned contact pressure adjusting mechanism will now be described.

First, the substrate 6 is held through a substrate attachment film 5 to the lower surface of the polishing head 4. In this condition, the substrate 6 held to the polishing head 4 is pressed on the upper surface of the polishing pad mounted on the polishing plate under a given polishing pressure applied from pressuring means (not shown), and the polishing head 4 is rotated to polish the substrate 6. In general, an outer circumferential portion of the substrate 4 tends to be polished more than a central portion of the substrate 4 because of a difference in smoothness of flow of a polishing agent supplied onto the upper surface of the polishing pad on the polishing plate.

According to the polishing device of the first preferred embodiment, however, each clamping screw 14 is loosened in the above case to cancel the clamped condition of each weight load member 13. Then, each weight load member 13 Is moved toward the center of the polishing head 4 (in the direction of an arrow R1 shown in FIG. 1A) to a suitable position. Then, each clamping screw 14 is tightened again at this position.

Accordingly, the contact pressure of the substrate 6 against the upper surface of the polishing pad on the polishing plate is changed so that the contact pressure at the central area of the substrate 6 becomes larger than that at the outer circumferential area of the substrate 6 by the own weight of each weight load member 13. As a result, it is possible to eliminate variations in amount of the polishing agent in the plane of the surface of the substrate 6 due to a difference in amount of the polishing agent to be supplied over the upper surface of the polishing pad during polishing.

In the case where the surface of the substrate 6 to be polished is tapered, for example, the contact pressure can be adjusted by individually moving the weight load members 13 in the following manner.

In accordance with the relation between the mounting angle of the substrate 6 in respect of the circumferential direction thereof and the position of each weight load member 13, for example, the weight load member 13 positioned over a thin area of the substrate 6 is moved toward the outer circumferential portion of the polishing head 4 (in the direction of an arrow R2 shown in FIG. 1A), and the weight load member 13 positioned over a thick area of the substrate 6 is moved toward the central portion of the polishing head 4 (in the direction of the arrow R1 in FIG. 1A).

Accordingly, the contact pressure of the substrate 6 at its thick area against the upper surface of the polishing pad can be made larger than the contact pressure of the substrate 6 at its thin area against the upper surface of the polishing pad by the changed positions of the weight load members 13 during polishing. As a result, a taper-free surface of the substrate 6 can be obtained after polishing.

In the polishing device of the first preferred embodiment as described above, the in-plane contact pressure of the substrate 6 can be adjusted for each portion of the substrate surface area by moving the weight load members 13 engaged with the guide members 12 in suitable directions (R1, R2) according to various circumstances including the difference in supply amount of the polishing agent on the surface of the substrate 6 between its areas and the surface condition of the substrate 6, thus correcting the contact pressure distribution in the plane of the surface of the substrate 6 during polishing to eliminate the nonuniformity of polishing in the plane of the surface of the substrate 6.

Alternatively, the in-plane contact pressure of the substrate 6 may be adjusted at its every area by preliminarily forming many mounting holes on the upper surface of the polishing head 4 and mounting or demounting weight load members having arbitrary shapes into or out of these mounting holes of the polishing head 4. However, the above-mentioned configuration shown in FIGS. 1A and 1B is more preferable, because the guide members 12 extending in the radial direction of the polishing head 4 are mounted on the upper surface of the polishing head 4, and the weight load members 13 are movably engaged with the guide members 12, thereby allowing the adjustment of the in-plane contact pressure of the substrate 6 to be carried out simply by moving the weight load members 13. Further, fine adjustment of the contact pressure can also be allowed by finely moving the weight load members 13

Conventionally known as a kind of such polishing device is a multihead type polishing device having a plurality of polishing heads for the purpose of improvement in throughput. Further, also known as another kind of such polishing device is one having a dressing function adopting a so-called concurrent dressing method.

Figure 3A:
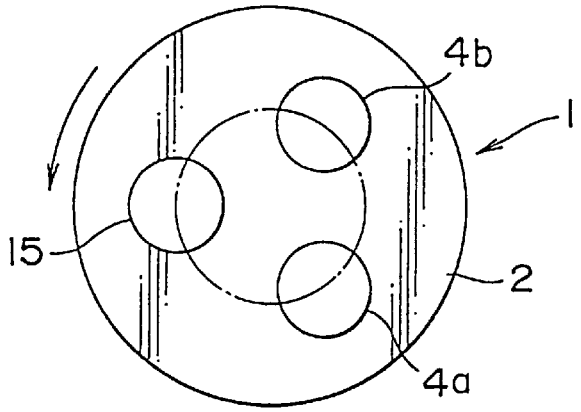
FIGS. 3A and 3B are a top plan view and a side view, respectively, of a conventional multihead type polishing lead, illustrating a problem therein.
Figure 3B:
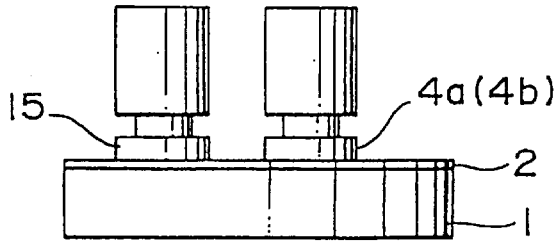

FIGS. 3A and 3B show the configuration of such a multihead type polishing device having two polishing heads and adopting a concurrent dressing method in the prior art, in which FIG. 3A is a schematic top plan view of this polishing device and FIG. 3B is a schematic side view of FIG. 3A.

Referring to FIGS. 3A and 3B, two polishing heads 4*a* and 4*b* are opposed to a polishing pad 2 attached to the upper surface of a polishing plate 1, and a dresser 15 for dressing the upper surface of the polishing pad 2 is also opposed to the polishing pad 2 so as to be placed on the same circle as the circle on which the polishing heads 4*a* and 4*b* are placed.

In this configuration, two substrates (not shown) held on the lower surfaces of the polishing heads 4*a* and 4*b* can be simultaneously polished, and the upper surface of the polishing pad 2 can be concurrently dressed by the dresser 15 during polishing. Accordingly, uniform polishing with a higher :throughput can be effected as compared with a single-head type polishing device or a polishing device adopting an interval dressing method such that the dressing of the upper surface of a polishing pad is carried out after completion of polishing.

In the above-mentioned configuration shown in FIGS. 3A and 3B, variations in polishing amount between lots due to loading of the polishing surface of the polishing pad 2 can be reduced by adopting the concurrent dressing method. However, when the polishing plate 1 is rotated in one direction (e.g., in a counterclockwise direction as shown in FIG. 3A) during polishing, a portion of the upper surface of the polishing pad 2 dressed by the dresser 15 is first passed under the polishing head 4*a* and is next passed under the polishing head 4*b*. As a result, there occurs a difference in dressed condition of the upper surface of the polishing pad 2 between at the polishing head 4*a* and at the polishing head 4*b*, causing variations in polishing amount between The polishing heads 4*a* and 4*b* .

A second preferred embodiment of the present invention intended to eliminate the above problem will now be described in detail with reference to FIG. 4.

Figure 4:
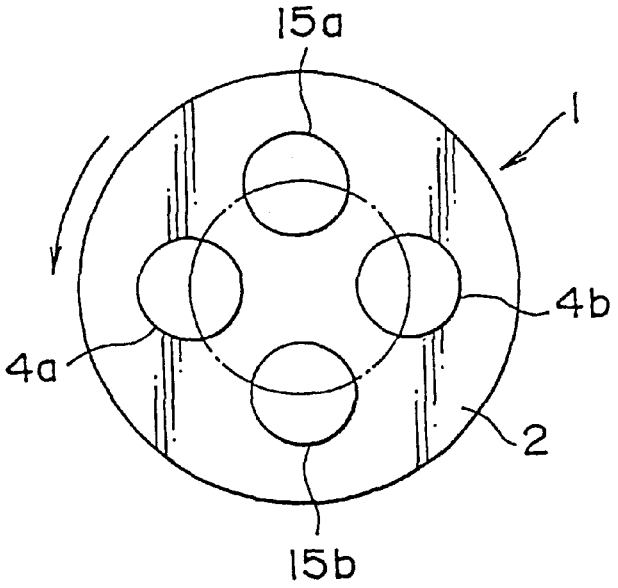
FIG. 4 is a top plan view of a polishing device according to a second preferred embodiment of the present invention.

FIG. 4 is a schematic top plan view illustrating the second preferred embodiment of the polishing device according to the present invention.

Referring to FIG. 4, the polishing device is a multihead type polishing device having a plurality of (two in this preferred embodiment) polishing heads 4*a* and 4*b* opposed to a polishing pad 2 mounted on a polishing plate 1 and further having two dressers 15*a* and 15*b* for dressing the upper surface of the polishing pad 2. The two dressers 15*a* and 15*b* are provided so as to respectively correspond to the two polishing heads 4*a* and 4*b*.

In this preferred embodiment, the dressers 15*a* and 15*b* and the polishing heads 4*a* and 4*b* are alternately placed on the same circle. More specifically, the two polishing heads 4*a* and 4*b* are placed on a circle symmetrically with each other with respect to the center of rotation of the polishing plate 1, and the two dressers 15*a* and 15*b* are placed on the same circle as that of the two polishing heads 4*a* and 4*b* at symmetrical positions shifted in phase by 90° from the positions of the polishing heads 4*a* and 4*b*.

In the second preferred embodiment, when the polishing plate 1 is rotated in one direction (e.g., in a counterclockwise direction as shown in FIG. 4) in polishing, a portion of the upper surface of the polishing pad 2 dressed by the first dresser 15*a* is immediately passed under the first polishing head 4*a*, and simultaneously a portion of the upper surface of the polishing pad 2 dressed by the second dresser 15*b* is immediately passed under the second polishing head 4*b*. Thus, the portions of the upper surface of the polishing pad 2 just dressed by the dressers 15*a* and 15*b* can be always supplied to the polishing heads 4*a* and 4*b*, respectively. Accordingly, it is possible to eliminate variations in polishing amount between the polishing heads 4*a* and 4*b* due to a difference in dressed condition of the upper surface of the polishing pad 2 between at the polishing head 4*a* and at the polishing head 4*b*.

Figure 5:
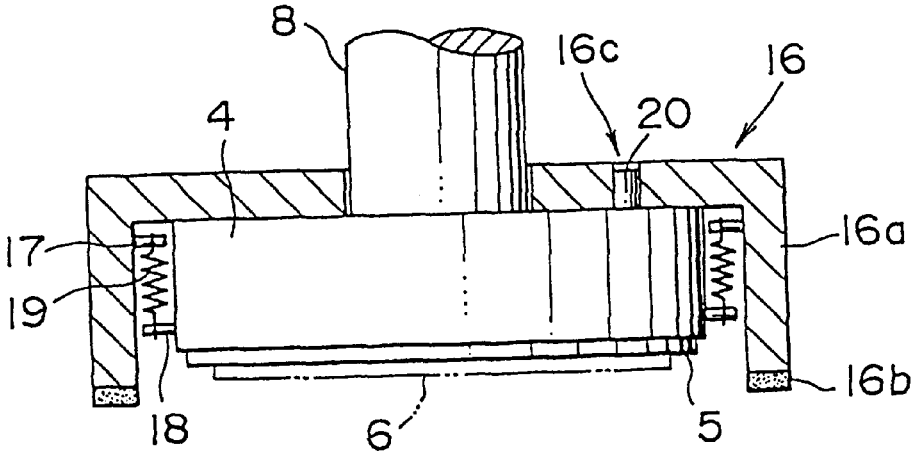
FIG. 5 is a sectional side view illustrating a modification of the second preferred embodiment.

FIG. 5 shows a modification of the second preferred embodiment of the present invention.

In this modification, a dresser 16 for dressing the pad surface is integrated with each polishing head 4 in a multihead type polishing device.

The dresser 16 consists generally of a cup-shaped dresser body 16*a* and a dressing element 16*b* provided at the lower end of the dresser body 16*a*. The dresser body 16*a* is vertically movably engaged at its center with a head rotating shaft 8 supporting the polishing head 4. A pin 17 is mounted on the inner circumferential surface of the dresser body 16*a*, and a pin 18 is mounted on the outer circumferential surface of the polishing head 4. An extension coil spring 19 is engaged at its opposite ends with the pins 17 and 18. The top wall of the dresser body 16*a* is formed with a through hole 16*c*, and a stopper pin 20 mounted on the upper surface of the polishing head 4 is inserted in the through hole 16*c*.

With this structure, while not polishing, the dresser body 16*a* is always kept in pressure contact with the upper surface of the polishing head 4 by the biasing force of the extension coil spring 19. In this condition, the dressing element 16*b* projects toward the polishing pad from the level of a substrate 6 held on the lower surface of the polishing head 4 through a substrate attachment film 5. Further, undue rotation of the dresser 16 relative to the head rotating shaft S can be restricted by the stopper pin 20.

When polishing is started to lower each polishing head 4 toward the polishing plate under a polishing pressure applied from pressurizing means (not shown), the dressing element 16*b* of each dresser 16 first comes into contact with the pad surface. Thereafter, the dresser body 16*a* is separated from the upper surface of the polishing head 4 against the biasing force of the extension coil spring 19, and the substrate 6 held on the polishing head 4 is pressed on the pad surface by the polishing pressure applied from the pressurizing means. Accordingly, the dressing element 16*b* of the dresser 16 is pulled by the biasing force of the extension coil spring 19 to come into pressure contact with the pad surface. In this condition, each polishing head 4 is rotated to make the pad surface polish the substrate 6, and each dresser 16 is also rotated to make the dressing element 16*b* dress the pad surface.

Also in this modification applied to the multihead type polishing device having the plural polishing heads 4, the pad surface just after dressed by the dressers 16 can be supplied to the respective polishing heads 4 because each dresser 16 is integrated with the corresponding polishing head 4. Therefore, as similar to the second preferred embodiment shown in FIG. 4, variations in polishing amount between the polishing heads 4 due to a difference in dressed condition between areas of the pad surface are eliminated.

In particular, according to this modification, the integration of each polishing head 4 and the corresponding dresser 16 allows a great reduction in limitation of a space for installing the dressers 16 in the multi head type polishing device, thereby allowing more polishing heads to be provided in comparison with the structure shown in FIG. 4. Moreover, since each dresser 16 and the corresponding polishing head 4 are rotated by a common rotational driving source, any additional rotational driving source for each dresser 16 is not required.

Incidentally, the pad surface of the polishing pad is gradually worn as the polishing of many substrates is carried out by pressing the substrates on the pad surface under rotation. The shape of the pad surface is transferred to the surface of each substrate to be polished according to the maternal principle of the polishing device. Therefore, it is necessary to true the pad surface worn, so as to maintain a constant polishing accuracy. The truing of the pad surface is intermittently carried out by a dresser, and measurement of the shape of the pad surface trued is made by using a dial gauge or the like mounted on a rodlike mounting member extending over the polishing plate. In measuring the shape of the pad surface, a measuring element of the dial gauge is made contact with the pad surface to read a dial of the dial gauge.

According to such measuring means using the dial gauge, the measuring element is made contact with the pad surface. Accordingly, there occurs a large error in the measurement result according to whether the measuring element comes into a recess on the porous pad surface or comes into a projection on the porous pad surface. Further, when many points of measurement are set, much time is required to read the dial, resulting in an increase in measurement time. Accordingly, such measuring means is unsuitable for multipoint measurement. Thus, it is greatly difficult to accurately grasp the shape of the pad surface as a continuous curved line in the prior art.

A third preferred embodiment of the present invention intended to solve this problem will now be described in detail with reference to FIG. 6.

Figure 6:
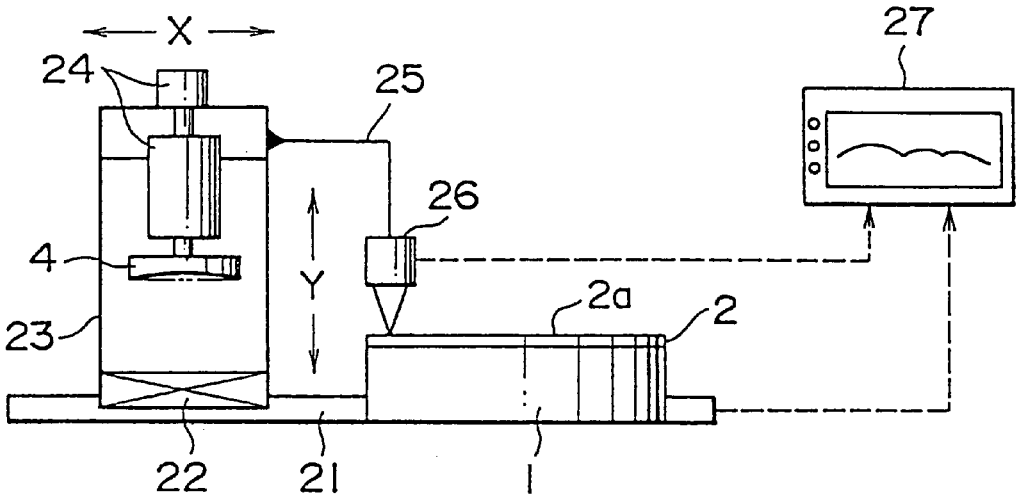
FIG. 6 is a schematic side view of a polishing device according to a third preferred embodiment of the present invention.

FIG. 6 is a schematic illustration of the third preferred embodiment of the polishing device according to the present invention.

Referring to FIG. 6, a column 23 as a moving member is movably supported through a linear guide 22 to a guide rail 21 extending in a radial direction of a polishing plate 1. A polishing head 4 with rotational driving means 24 is mounted on the column 23. In polishing, the column 23 is rotated to make the polishing head 4 face a pad surface 2*a* of a polishing pad 2 mounted on the polishing plate 1. A displacement sensor 26 is mounted through a sensor mounting member 25 on one side surface of the column 23. The displacement sensor 26 is a noncontact type laser displacement meter, for example, and it is opposed to the polishing pad 2, so as to detect a change in shape of the pad surface 2*a* of the polishing pad 2 according to an amount of linear movement of the column 23. A sensor output signal line from a linear sensor (not shown) for detecting an amount of movement of the linear guide 22 and a sensor output signal line from the displacement sensor 26 are both connected to dedicated terminals of an X-Y recorder 27.

The operation of the third preferred embodiment in measuring the shape of the pad surface 2*a* will now be described.

After polishing a substrate, it is removed from the polishing head 4. Thereafter, the column 23 is rotated to retract the polishing head 4 from the upper side of the polishing plate 1, and subsequently the displacement sensor 26 is so set as to face the pad surface 2*a*.

Thereafter, the column 23 is moved in the radial direction of the polishing plate 1 (in the X-direction shown), so that the displacement sensor 26 is moved from a peripheral portion of the polishing pad 2 toward a central portion thereof. At this time, data of travel of the column 23 detected by the linear sensor are plotted as data of displacement in the X-direction by the X-Y recorder 27, and data of distance from the displacement sensor 26 to the pad surface 2*a* detected by the displacement sensor 26 are plotted as data of displacement in the Y-direction by the X-Y recorder 27.

Accordingly, the profile of the pad surface 2*a* is displayed as a continuous curved line by the X-Y recorder 27, so that the shape of the pad surface 2*a* can be accurately determined in a very short time.

As a result, in correcting the shape of the pad surface 2*a* (i.e., in truing the pad surface 2*a*), the conditions of truing can be properly set, and the determination of whether or not the pad surface 2*a* is in a good condition can be accurately performed.

Further, since the shape of the pad surface 2*a* can be accurately determined, the shape of the pad surface 2*a* can be set as one of parameters of polishing conditions, and the measured shape of the pad surface 2*a* can also be effectively used as data for quality control.

Further, since the displacement sensor 26 is a noncontact sensor in this preferred embodiment, the shape of the pad surface 2*a* can be accurately measured without the dependence on the hardness of the polishing pad 2.

There will now be described a method for correcting the film surface of the substrate attachment film attached to the polishing head.

In general, in constructing a polishing device, a substrate attachment film prepared with outside exchange of die is attached to a polishing head machined with outside exchange of die. Thereafter, the polishing head with the substrate attachment film attached thereto is mounted through a joint to a head rotating shaft. Accordingly, the film surface of the substrate attachment film does not properly match a pad surface preliminarily trued to an ideal shape inside the device, with the result that this mismatch causes nonuniformity of polishing in the plane of the surface of a substrate to be polished.

To solve this problem, the film surface of the substrate attachment film is corrected by the method according to the present invention.

Figure 7:
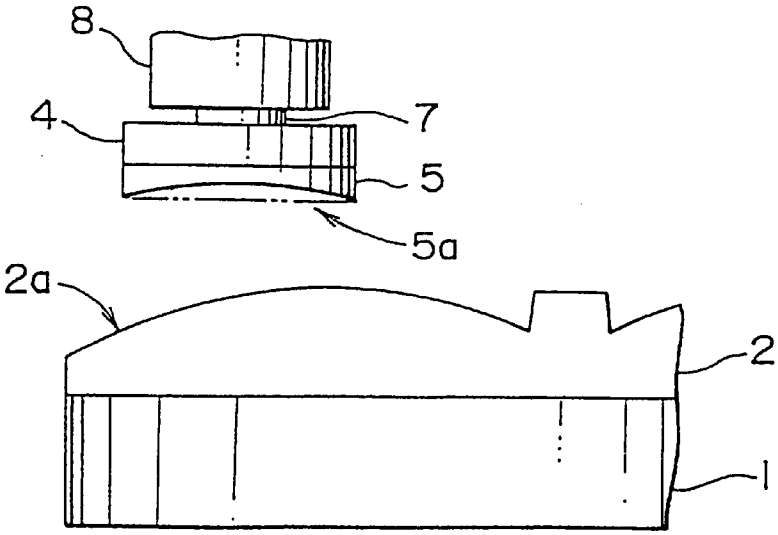
FIG. 7 is a fragmentary side view illustrating a correcting method for a polishing device according to a preferred embodiment of the present invention.
Figure 8:
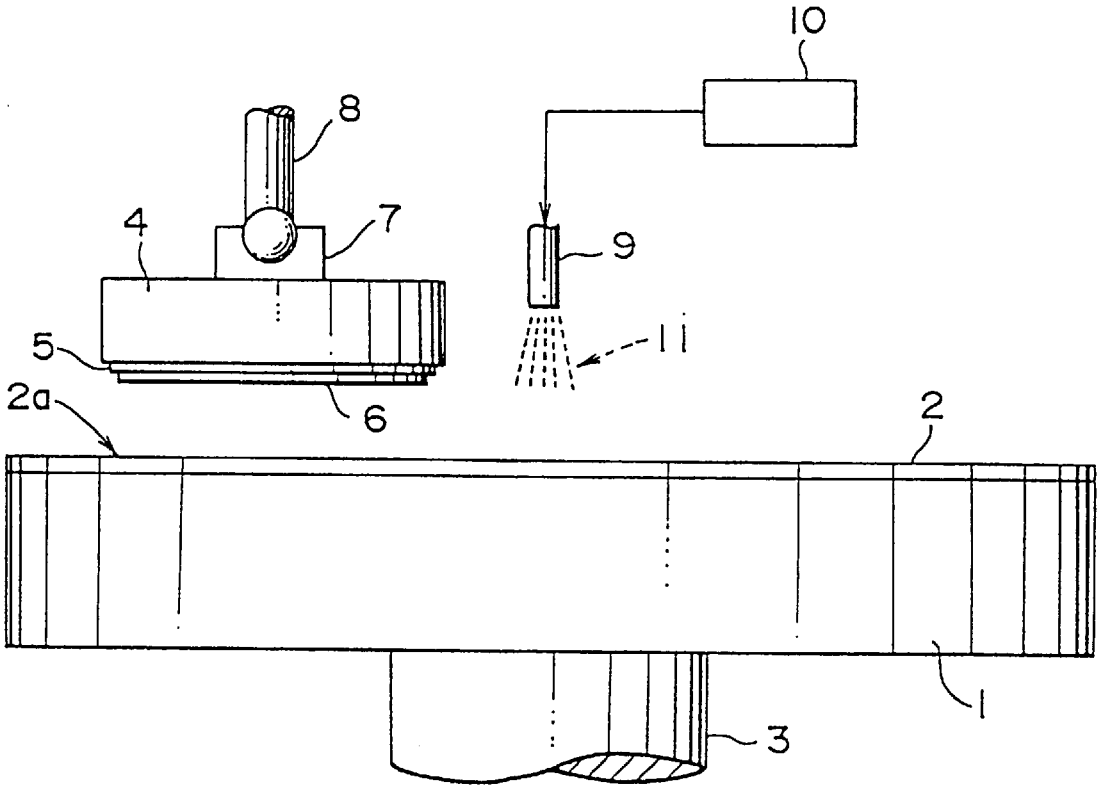
PRIOR ART FIG. 8
FIG. 8 is a schematic side view of a polishing device in the prior art.

FIG. 7 is a schematic illustration of a preferred embodiment of the correcting method according to the present invention. Referring to FIG. 7, after mounting a polishing head 4 through a joint 7 to a head rotating shaft 8, a substrate attachment film 5 is attached to the polishing head 4 and no substrate to be polished is set on the polishing head 4 through the substrate attachment film 5. In this condition, a polishing plate 1 and the polishing head 4 are rotated.

Thereafter, the substrate attachment film 5 attached to the polishing head 4 is pressed against a pad surface 2*a* of a polishing pad 2 mounted on the polishing plate 1 under a given pressure applied from pressurizing means (not shown), thereby making a film surface 5*a* of the substrate attachment film 5 rub against the pad surface 2*a* preliminarily trued to an ideal shape.

Accordingly, the ideal shape of the pad surface 2*a* of the polishing pad 2 is transferred to the film surface 5*a* of the substrate attachment film 5, thereby obtaining the match between the pad surface 2*a* and the film surface 5*a* to eliminate he nonuniformity of polishing in the plane of the surface of the substrate during polishing.

While the invention has been described with reference to specific embodiments, the description is illustrative and Is not to be construed as limiting the scope of the invention. Various modifications and changes may occur to those skilled in the art without departing from the spirit and scope of the invention as defined by the appended claims.

What is claimed is:

1. In an improved polishing device including a polishing plate having an upper surface on which a polishing pad is attached, and a plurality of polishing heads each having a lower surface opposed to an upper surface of said polishing pad on said polishing plate, for holding a plurality of substrates to be polished on said lower surface, whereby said substrates held by said polishing heads are pressed against said upper surface of said polishing pad to perform polishing of said substrates, the improvement comprising:

a plurality of dressers provided with said plurality of polishing heads, wherein at least one of said plurality of dressers corresponds to and is integrated with at least one of said plurality of said polishing heads, whereby said upper surface of said polishing pad can be dressed by said plurality of dressers concurrently with the polishing of said substrates by said plurality of said polishing heads; and a plurality of extension coil springs for normally biasing each of said dressers to the corresponding polishing head.

2. In an improved polishing device including a polishing plate having an upper surface on which a polishing pad is attached, and a plurality of polishing heads each having a lower surface opposed to an upper surface of said polishing pad on said polishing plate, for holding a plurality of substrates to be polished on said lower surface, whereby said substrates held by said polishing heads are pressed against said upper surface of said polishing pad to perform polishing of said substrates, the improvement comprising:

a plurality of dressers provided with said plurality of polishing heads, wherein said dressers and said polishing heads are alternately placed on a common circle, with said dressers being placed at equal intervals on said common circle, and said polishing heads also being placed at equal intervals on said common circle, and wherein at least one of said plurality of dressers corresponds to at least one of said plurality of said polishing heads, whereby said upper surface of said polishing pad can be dressed by said plurality of dressers concurrently with the polishing of said substrates by said plurality of said polishing heads.

* * * * *